US005226725A

United States Patent [19]

Trusiani

[11] Patent Number: 5,226,725

[45] Date of Patent: Jul. 13, 1993

[54] ILLUMINATED MAP DEVICE

[76] Inventor: Paul J. Trusiani, 420 Ravina St., La Jolla, Calif. 92037

[21] Appl. No.: 813,897

[22] Filed: Dec. 23, 1991

[51] Int. Cl.[5] ..... G09F 13/04

[52] U.S. Cl. ..... 362/351; 362/809; 362/812; 40/569; 434/145

[58] Field of Search ..... 434/150, 153, 145, 147; 362/98, 253, 809, 351, 812; 40/547, 579, 541, 564, 569, 580

[56] References Cited

U.S. PATENT DOCUMENTS 2,758,401 8/1956 Wilson ..... 40/564
4,276,705 7/1981 Barth et al. ..... 434/153 X
4,449,941 5/1984 McGuire et al. ..... 434/153

*Primary Examiner*—Richard R. Cole
*Attorney, Agent, or Firm*—Brown, Martin, Haller & McClain

[57] ABSTRACT

A hollow housing which may be flat or in the shape of a sphere has a map extending over at least part of its outer surface representing at least some of the topographical features of the Earth's surface. The map is formed at least partially by openings in the surface, and a light source inside the housing illuminates the openings so that they will stand out in a darkened room. The openings may be holes at the locations of major cities, cuts extending along the continents and rivers separated by bridges, and cut-outs representing major lakes and inland seas.

8 Claims, 1 Drawing Sheet

ILLUMINATED MAP DEVICE

BACKGROUND OF THE INVENTION

The present invention relates generally to maps and globes, and is particularly concerned with an illuminated map device.

Maps of the Earth's surface are known in various forms, including planar maps and globes. Traditional globes are generally made as solid or hollow spheres with the outer surface imprinted or painted with various topographical features. Maps are also made out of various materials such as paper and engraved metal for wall hanging as posters or pictures. Accuracy of mapping has been considerably improved with the advent of aerial surveys, both from aircraft and satellites.

SUMMARY OF THE INVENTION

It is an object of the present invention to provide a new map device.

According to the present invention, an illuminated map device is provided which comprises a hollow outer housing, at least part of the surface of the outer housing having a plurality of openings at predetermined positions corresponding to at least some of the topographical features of the Earth's surface, and a light source inside the outer housing for illuminating the openings so as to provide an illuminated representation of at least part of the Earth's surface. An internal power supply may be provided, or alternatively wiring may be provided for connecting the light source to an external or main power supply.

In one embodiment of the invention the outer housing comprises a picture frame having a front panel of opaque material such as metal, for example, in which openings are cut to represent selected topographical features. For example, linear slits or openings may be cut at spaced intervals to follow the contours of the continents. Holes may also be cut at the locations of major cities. Openings may also be cut either at spaced intervals or as continuous slits or lines to follow such features as major lakes and rivers.

This provides an attractive illuminated map which may be hung on a wall. The illuminated openings will stand out dramatically in a darkened room. If openings are cut only at the locations of major cities, the device provides a display representative of the Earth at night as viewed from space. If lines are cut to follow the contours of continents, the continents will stand out dramatically when viewed in a darkened room.

In an alternative embodiment the outer housing comprises a hollow sphere or globe with openings cut across its entire surface to represent selected topographical features. The device may have a stand for supporting on a suitable flat surface, or may have a suitable suspension device for suspending from a ceiling, for example. When viewed in a darkened room, this provides a realistic representation of the Earth suspended in space. Traditional maps and globes do not provide a realistic representation of the Earth as it appears at night, whereas when the illuminated map device of this invention is viewed in dim light or in the dark, the topographical features represented by openings in the surface will shine brightly and stand out to the observer.

BRIEF DESCRIPTION OF THE DRAWINGS

The present invention will be better understood from the following detailed description of some preferred embodiments of the invention, taken in conjunction with the accompanying drawings, in which like reference numerals refer to like parts, and in which.

DESCRIPTION OF THE PREFERRED EMBODIMENTS

Figure 4:
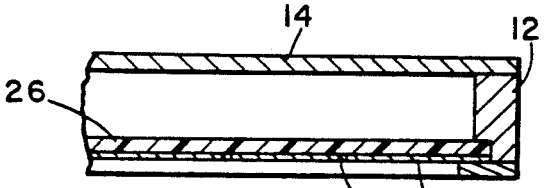
FIG. 4 is an exploded partial sectional view similar to FIG. 3, showing a modification.

FIGS. 1 to 4 illustrate a wall hanging map device 10 according to a first embodiment of the present invention. The device comprises a generally rectangular frame 12 having a back panel 14 and an open front face across which a map panel or sheet 15 is secured by adhesive or other fastening means. One or more light sources such as light bulb 16 are mounted on back panel 14 inside the frame 12, as best illustrated in FIG. 4. The or each light bulb is connected via suitable wiring 18 to a power supply, such as a main power outlet. Although the frame is rectangular in the illustrated embodiment, it will be understood that other shapes may be used in alternative embodiments, such as circular, oval, and other standard picture frame shapes. A suitable opening or door will be provided in back panel to provide access to the light bulb or bulbs for replacement purposes.

Figure 1:
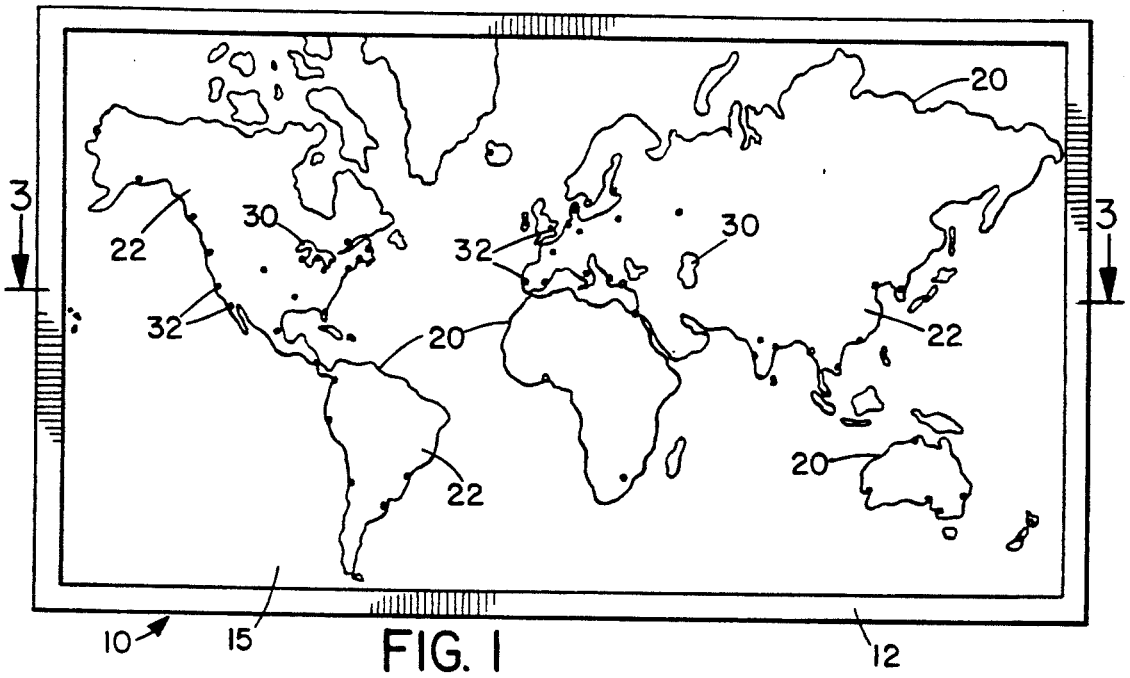
FIG. 1 is a perspective view of an illuminated, wall hanging map device according to a first embodiment of the present invention.
Figure 3:
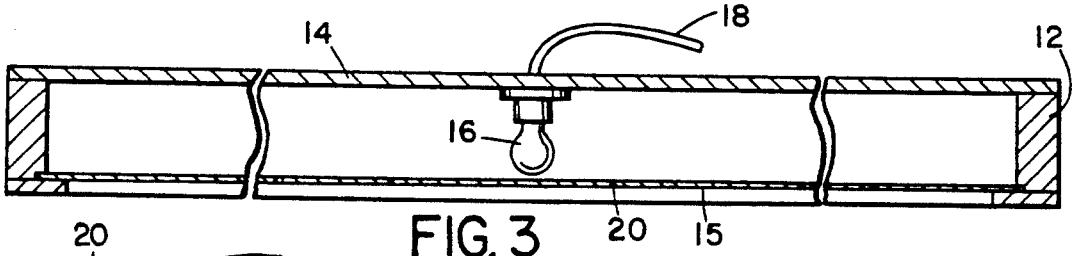
FIG. 3 is a section on the lines 3—3 of FIG. 1.
Figure 2:
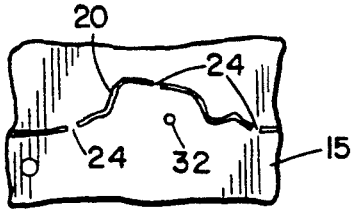
FIG. 2 is an exploded view of part of the map surface of the device of FIG. 1.

The map sheet 15 is of sheet material such as metal or opaque plastic, and in a preferred embodiment of the invention is of sheet metal such as brass, steel or copper which will have an attractive appearance, the metal being of thickness approximately 0.036 inches. Topographical features of some or the entire surface of the Earth are marked across the map sheet by means of openings at appropriate positions which are cut through the sheet via a laser cutting process or the like. For example, representations of the Earth's continents are made by a series of continuous cuts or slits 20 extending along the boundaries of continents 22, the cuts 20 along each boundary being separated via spaced bridges or gaps 24 where the material is not cut, as best illustrated in FIG. 2. Thus, each continent 22 is secured to the remainder of the map sheet 15 by a plurality of bridges 24. Alternatively, or additionally, the map sheet could be backed by a transparent plastic backing layer 26 for supporting the cut-out continents, as illustrated in FIG. 4, the map sheet being adhesively secured to the backing layer 26 if necessary. The cuts 20 are preferably of the order of 0.008 inches in width. Instead of continuous cuts 22, the continental boundaries may alternatively be represented by a series of spaced holes cut along the boundaries.

Other topographical features are represented on the map sheet by cuts or openings. For example, the major rivers such as the Amazon, the Nile and the Ganges are formed by similar continuous cuts or lines 28 extending along the rivers. Major lakes and inland seas can also be represented by cuts extending around their boundaries, but in the illustrated embodiment all lakes and inland seas above a predetermined size are formed by cutting out areas 30 corresponding in shape to the respective lakes or inland seas. Major cities, for example all capitol cities or cities above a predetermined size, are represented by holes 32 cut out at the appropriate locations. The size of the city holes may differ, with each city hole having a size which is proportional to the city population, for example.

When viewed in a darkened room with the internal light source or sources turned on, all the cut lines and holes will be illuminated and will stand out from the rest of the map surface. This provides a very effective and attractive display of the selected topographical features. If desired, different color light bulbs may be used to back light different regions of the map sheet, providing a varying color display. By illuminating the major cities through cut holes, a dramatic visual display of the development of mankind and the regions of population density is provided, which is not possible with standard maps and globes. The hanging illuminated map device 10 will also have an attractive appearance in daylight, with the cuts and openings appearing as engravings in the shiny sheet metal surface.

Figure 5:
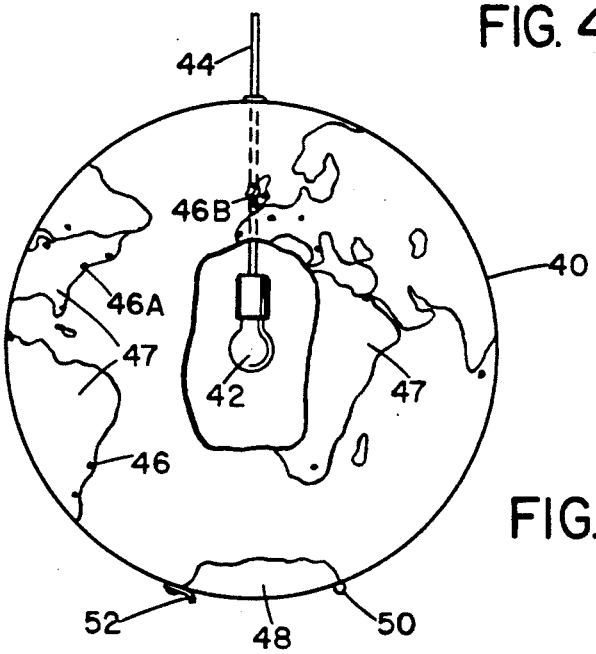
FIG. 5 is a perspective view, partially cut away, of an illuminated globe device according to another embodiment of the invention.

FIG. 5 illustrates an illuminated globe or sphere 40 according to an alternative embodiment of the invention. The sphere 40 is hollow, and has a suitable light source such as light bulb 42 at its center. The bulb 42 may be suspended via electrical wiring 44 extending through the top of the bulb to suspend the globe from the ceiling in a similar manner to a suspended ceiling light, as illustrated in the drawings. However, in an alternative arrangement, the globe may be mounted on a suitable stand similar to a lamp stand for standing on the floor or a table, with the bulb mounted in a suitable fitting projecting up from the bottom of the globe.

The globe may be made of any suitable material such as sheet metal, plastic, ceramic or the like. A representation of the major topographical features of the Earth's surface is provided on the globe, positioned in a manner equivalent to standard solid globes used for education and display purposes. Some or all of the selected topographical features are represented by cuts or holes through the surface of the globe, so that they will be illuminated by the internal light source in a darkened room. In the illustrated embodiment, all large cities are represented by holes 46 cut through the globe, with the size of the hole being proportional to the city size. Thus, in FIG. 5, it can be seen that the holes 46A and 46B representing Washington and New York, respectively, are much larger than the remaining city holes along the East Coast of the United States. The variation in hole size may be dependent on variables such as population, or other variables such as area, for example. Alternatively, all the capitol cities may be cut out in one size with all other cities being cut out in a second, smaller size, so that the capitol cities will stand out. For example, capitol cities may be represented by holes having a diameter twice that of the holes representing other cities. The globe may have the standard globe markings on its surface representing topographical features such as continents 47, apart from the cities and large towns, which are drilled holes. These topographical features may be painted or imprinted on the surface of the globe in the traditional manner. Alternatively, other topographical features such as continents, rivers and major lakes may be represented by cut lines or holes, as in the previous embodiment.

In the illustrated embodiment openings are cut only at the locations of major towns and cities, with sizes proportional to the respective populations. In this version, when the globe is viewed in a darkened room, it provides an accurate representation of the Earth at night, similar to satellite photographs of the Earth. When viewed in the dark or in dim light, the cities shine brightly and provide a dramatic and very attractive display of the development of mankind. In daytime, the globe can be viewed as a standard Earth globe. In an alternative embodiment, only the towns along sea coasts may be cut out, providing a representation of sea trade routes. Alternatively, continent lines may be cut out in addition to major cities, and other topographical features may be represented by holes or cut-out areas as desired.

Access to the interior of the globe for the purpose of changing the bulb when necessary is preferably provided by means of a cut-out or access door 48 in the shape of Antarctica in the bottom of the globe. The cut-out is secured via a hinge 50 at one side and a suitable closure such as hook 52 at the other side.

The globe may be made from any suitable material which is safe for use with an internal light source. For example, opaque plastic of the type used for traditional globes may be used. The plastic is molded into two hemispheres, and the desired holes and/or lines are cut using dental type drills, for example, or a computer operated laser drilling process. Any additional geographical markings may be painted onto the surface as desired. The two hemispheres are then suitably bonded together with the light source mounted inside the resultant sphere. Alternatively, the sphere may be made from sheet metal such as brass, steel or copper. The sheet metal is cut to a conventional shape for forming a hemisphere of the desired size, as is standard in the field. Two hemisphere forming flat shapes are cut. The flat sheets are then drilled with holes and slits at the desired locations either with a conventional mechanical punch press having punches set up at the appropriate locations, or sequentially using a suitably programmed laser drill. The two cut sheets are then cold pressed into hemispherical molds, and soldered together to form the complete sphere. The surface may be engraved or otherwise marked with other topographical features not represented by holes or cuts, if desired, so that the globe may be used in a standard fashion in daylight or in a lit room.

The illuminated map and globe devices described above provide a novel way of viewing the Earth which is much more dramatic than standard paper maps and solid globes. This allows a person to visualize the Earth at night, with a dramatic illuminated display of selected topographical features which will be brightly lit and stand out from the remainder of the surface when viewed in a darkened or dimly lit room.

Although some preferred embodiments of the invention have been described above by way of example only, it will be understood by those skilled in the field that modifications may be made to the disclosed embodiments without departing from the scope of the invention, which is defined by the appended claims.

I claim:

1. An illuminated display device, comprising:

a hollow housing having an outer surface surrounding an inner cavity;

at least part of the outer surface of the housing having a series of linear cuts at spaced intervals extending along predetermined lines to form a selected graphical display, the graphical display comprising a map having selected topographical features and the linear cuts extending along the outlines of the selected topographical features; and a light source positioned in the inner cavity for illuminating said cuts.

2. The device as claimed in claim 1, wherein said housing has holes at predetermined locations corresponding to the locations of at least the major cities on the Earth's surface.

3. The device as claimed in claim 1, wherein some of said linear cuts extend along predetermined lines corresponding to the contours of at least some of the rivers and lakes on the Earth's surface.

4. The device as claimed in claim 1, wherein the housing comprises a hollow sphere and the outer surface of the sphere has cuts across at least substantially the entire surface area for representing selected topographical features of the Earth's surface.

5. An illuminated map device comprising:

a hollow housing having an outer surface surrounding an inner cavity;

at least part of the outer surface of the housing comprising a map, representing at least some of the topographical features of the Earth's surface, the map having a plurality of openings at predetermined positions corresponding to selected topographical features;

a light source positioned in the inner cavity for illuminating said openings;

the housing comprising a picture frame and a flat front panel mounted in the picture frame, the front panel comprising said map and being of at least substantially opaque material apart from said openings; and said openings including linear cuts along predetermined lines at spaced intervals corresponding to the boundaries of the Earth's continents.

6. The device as claimed in claim 5, wherein said openings include at predetermined locations corresponding to the locations of at least the major cities on the Earth's surface.

7. The device as claimed in claim 6, wherein the holes are of at least two different sizes, the larger size holes representing capitol cities.

8. The device as claimed in claim 7, wherein each hole is of a predetermined size proportional to the population size of the city represented by the respective hole.

* * * * *